United States Patent [19]

Rowe

[11] 4,141,612

[45] Feb. 27, 1979

[54] PORTABLE STORAGE APPARATUS

[76] Inventor: Robert Rowe, 1840 Bloor St. E. #1011, Mississauga, Ontario, Canada, L4X 1 T2

[21] Appl. No.: 838,103

[22] Filed: Sep. 30, 1977

[51] Int. Cl.[2] ..... A47F 5/08

[52] U.S. Cl. ..... 312/245; 312/107; 211/86; 248/354 S

[58] Field of Search ..... 312/245, 246, 247, 249, 312/253, 255, 107; 248/354 S, 356; 211/86; 403/118, 341, 343

[56] References Cited

U.S. PATENT DOCUMENTS

| | | | |
|---|---|---|---|
| 1,763,306 | 6/1930 | Hendrickson | 312/107 |
| 1,879,826 | 9/1932 | Shaffer | 248/356 |
| 2,051,420 | 8/1936 | Renholdt | 211/86 |
| 2,830,863 | 4/1958 | Fehr | 312/245 |
| 3,280,527 | 10/1966 | Faust | 248/356 |

FOREIGN PATENT DOCUMENTS

| | | | |
|---|---|---|---|
| 744094 | 4/1933 | France | 248/354 S |
| 63577 | 9/1955 | France | 248/354 S |
| 1562197 | 4/1969 | France | 248/354 S |
| 88503 | 9/1952 | Norway | 248/354 S |

*Primary Examiner*—Victor N. Sakran
*Attorney, Agent, or Firm*—Robert D. Farkas

[57] ABSTRACT

A portable storage apparatus utilizes a cabinet having a rubber-like gasketing material affixed to an uppermost lateral surface thereof. A pair of extensible post-like members are affixed to the cabinet so as to extend downwardly therefrom aligned with the rearmost surface of the cabinet. The lowermost region of the posts are off-set so as to follow the contour of a baseboard molding affixed to a wall in the vicinity in which the cabinet is installed having the rubber-like gasketing material clampingly engaging the lower surface of the interior ceiling in the room in which it is installed. The extensible posts, when extended, cause the upper lateral surface of the cabinet to be disposed directly beneath the interior ceiling surface.

2 Claims, 3 Drawing Figures

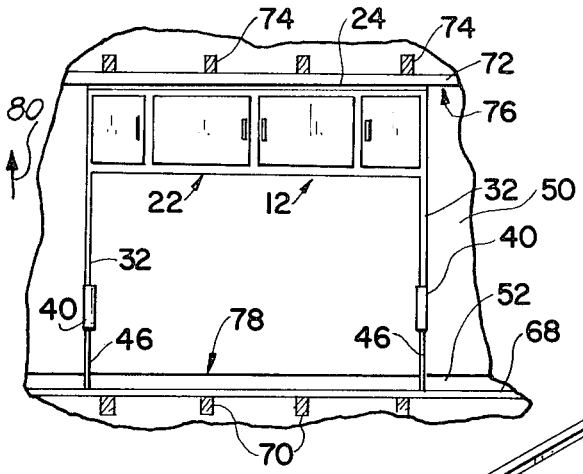
FIG. 2
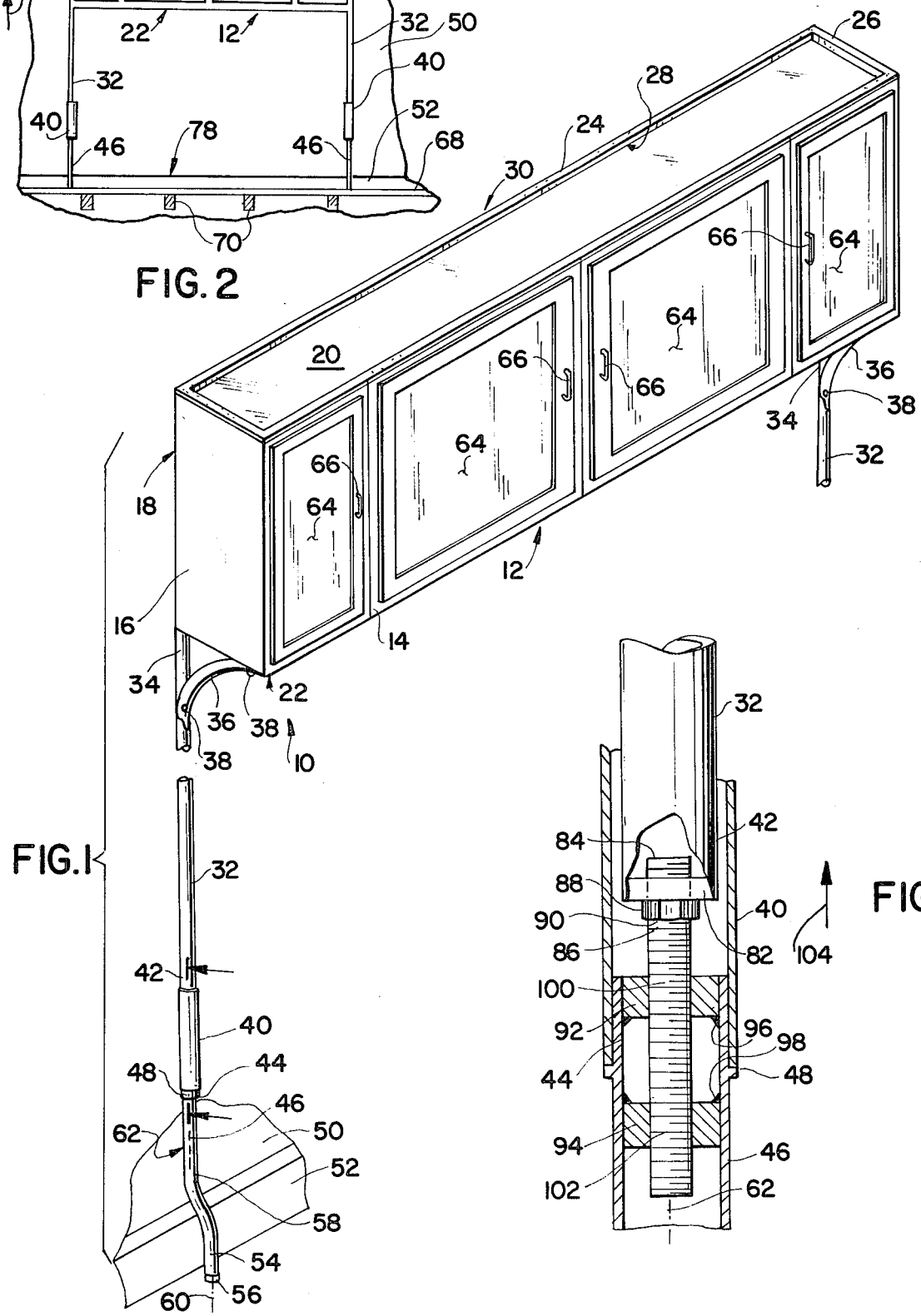
FIG. 1
FIG. 3

PORTABLE STORAGE APPARATUS

BACKGROUND OF THE INVENTION

1. The Field of the Invention

This invention relates to portable storage devices and more particularly to that class of device adapted for use in quasi-permanent installations in the interior of a room by engaging a portion of a ceiling and supported by an area of the floor therebelow.

2. Description of the Prior Art

The prior arts abounds with devices used as shelves which extend between a portion which extends between a ceiling and floor by clamping engagement therewith. Extensible columns are usually utilized. U.S. Pat. No. 3,709,166 issued Jan. 9, 1973 to P. S. Bush is typical of such a device. The Bush apparatus discloses a shelf positioning and holding means wherein the shelves are slidably mounted on vertical poles. The openings thru the shelves for receiving the poles provided with downwardly extending tines adjacent the poles, which tines are compressed tightly against the poles by specially designed complementary collars. The ceiling is simply utilized to provide a means for positioning and supporting the vertical poles.

U.S. Pat. No. 3,280,527 issued on Oct. 25, 1966 to E. Faust discloses an axially extensible column construction with an upper tubular bearing cap adapted to clampingly engage a ceiling being urged upwardly by an internal spring carried by the column. Thus, the cap is urged into touching engagement with the ceiling whilst the lowermost region of the column rests on the ground therebelow. Brackets are provided on the exterior surface of the column utilized to support shelving or other storage-like devices.

Both of the aforementioned apparatuses fail to disclose a device which is useful in supporting a cabinet from a floor and utilizes a ceiling therefore. Such devices fail to teach a means to support a cabinet wherein the uppermost lateral surface of such cabinet is maintained dust free and which provides openable compartments for storage of articles.

SUMMARY OF THE INVENTION

A primary object of the present invention is to provide a portable storage apparatus conveniently and easily installed within a room utilizing the ceiling and floor therefor without requiring the need for fastening devices such as screws and bolts marring the surface of walls, floor, or ceiling.

Another object of the present invention is to provide a storage device wherein the area of engagement of the ceiling is substantial thereby minimizing the possibility of marring the ceiling which may be exposed to view when the storage device is moved to another location or removed from use.

Still another object of the present invention is to provide a portable storage device which accommodates convenient installation in a room abutting a wall thereof so as to accommodate and maximize the use of the area immediately below the cabinet for other purposes.

Yet another object of the present invention is to provide a storage device which may be adjusted in height so as to be conveniently installed in rooms whose height varies.

Another object of the present invention is to provide a storage apparatus which is adapted to accommodate a molding located adjacent the intersection of a wall and floor below the location of the cabinet.

Still another object of the present invention is to provide a storage device which utilizes only a pair of support poles residing adjacent to and configured to follow the contours of the wall to which the cabinet is located.

Heretofore, devices have been utilized which extend upwardly from the floor, providing vertical support, towards the ceiling so as to come into clamping engagement therewith, utilizing an extensible pole therefor. Such poles are popular for providing support for lamps, shelves, display devices and alike. However, such devices invariably teach poles that are straight causing the poles, when installed along side walls provided with molding, to be located outwardly from the wall and towards the center of the room because of the thickness of the molding interfering with the capability of such poles being positioned flush against the surface of the wall. Furthermore, when the prior art poles were utilized to support heavy cabinets or shelves, the cap portions of the extensible poles frequently were forced into the surface of the ceiling so as to guarantee that the poles were rigidly secured to the ceiling preventing the accidental disengagement of the pole from the ceiling because of the heavy weight supported thereby. Marring frequently resulted which was unsightly when the apparatus was removed or moved to another location. Such poles, when utilized, support cabinets which were located in areas close to the ceiling resulting in the uppermost lateral surface of the cabinet being virtually inaccessible for cleaning purposes.

The present invention recognizes these difficulties and provides a pair of support poles to accommodate the protrusion of molding affixed to the wall and having a rubber-like gasket mounted to the uppermost surface of the cabinet so as to provide greater gripping force to the ceiling spread out over a substantial area, thus minimizing the possibility of marring. The rubber-like gasket also insures the uppermost surface of the cabinet is maintained in a dust-free condition.

These objects as well as other objects of the present invention will become more readily apparent after pending the following description of the accompanying drawings.

BRIEF DESCRIPTION OF THE DRAWINGS

FIG. 1 is a perspective view of the present invention.

FIG. 2 is a front elevation view of the present invention shown installed intermediate a floor and ceiling.

FIG. 3 is a side elevation cross-sectional view taken along line 3—3, viewed in the direction of arrow 3—3 as shown in FIG. 1.

DESCRIPTION OF THE PREFERRED EMBODIMENT

The structure and method of fabrication of the present invention is applicable to a rectangular cabinet having a rubber-like gasket material, in elongated strip form, disposed along the uppermost portions of the cabinet, having exterior marginal edges defining a rectangle equivalent in size to the rectangular shape of the cabinet. The interior marginal edges of the rubber-like gasket material may also be defined in forming a rectangle such that the rubber-like material forms a gasket extending around the perimeter of the uppermost surface of the cabinet. A pair of posts is secured to the cabinet such that the posts reside adjacent to the plane defined by the rearmost wall of the cabinet and extend downwardly from the cabinet in spaced apart parallel relationship. A pair of gusset-like members are attached to the base of the cabinet extending so as to be secured at one end thereof to the posts supporting the cabinet. The posts are made extensible by utilizing a lowermost portion and an uppermost portion, each having equivalent diameters. The lowermost portion is fitted with a pair of washer-like members whose openings are threaded. The uppermost member is fitted with a washer-like member installed in the lower region thereof having an opening therein. A threaded rod is threadingly engaged with the pair of washers installed at the uppermost end of the lowermost tubular member. The uppermost end of the rod is journaled within the opening in the uppermost washer installed at the lowermost end of the uppermost tubular member. A nut is fixedly secured intermediate the ends of the threaded rod such that the nut is caused to reside in touching engagement with the lowermost surface of the washer affixed to the lowermost end of the uppermost tube. Thus, when a wrench is engaged with the nut and turned in either direction, the threaded rod is caused to be moved axially along the longitudinal axis of the pair of tubes, otherwise coaxially aligned. This causes the pair of tubes to move relative to one another. A portion of the surface of the lowermost tube, adjacent to the uppermost end thereof is provided with an annular protrusion extending radially outwardly therefrom. A sleeve, fabricated from tubing, having an internal diameter slightly larger than the external diameter of both post members is adapted to slide upon the ends of both posts members. Thus, the tube laying manually positioned upwardly of the location of the nut, exposes the nut for rotation and expansibility of the pair of posts. When the tube is positioned downwardly so as to have its lowermost edge contact the protrusion of the lowermost post, the nut and the threaded rod is concealed presenting a neat finished appearance. The lowermost region of the lowermost post portion is bent so as to have the distalmost end thereof extend having its longitudinal axis parallel to the longitudinal axis of the uppermost portion of the lowermost post section. Thus, the lowermost region of the lowermost post portion are parallel to the uppermost region thereof. In use, the lowermost region may be rotated relative to the longitudinal axis of the uppermost region, thereby accommodating molding of various thicknesses which may be located intermediate the wall and floor below the location in which the cabinet is to be installed.

Now referring to the figures, and more particularly to the embodiment illustrated in FIG. 1 showing the present invention 10 utilizing cabinet 12 having front wall 14, side wall 16, rear wall 18 and uppermost surface 20. Lowermost surface 22 extends parallel to uppermost surface 20. Rubber-like gasketing material 24 is shown disposed having its outermost edges configured to coincide with walls 14, 16, 18 and 26. Gasket 24 is provided with innermost marginal edges 28, running parallel to outermost marginal edges 30. If desired, gasket material 24 may be in sheet form equivalent to marginal edges 30. Posts portion 32 are shown to have uppermost regions 34 thereof fixedly secured to lowermost surface 22 adjacent the intersection of rear wall 18 and side walls 16 and 26. Gusseting-like strut members 36 are shown secured to uppermost post member 32, utilizing bolts 38 therefor. Sleeve 40 is shown adjacent to lowermost region 42 of uppermost post 32 and region 44 of lowermost post 46. Sleeve 40 is shown residing on annular protrusion 48. A portion of wall 50 is shown abutting molding 52. End 54 of lowermost post 46 is shown provided with foot 56 adapted to rest upon a floor. Curved region 58 of lowermost post 46 is configured so as to have the longitudinal axis of the lowermost end 54, depicted by dotted line 60. Doors 64 are shown fitted to wall 14 and are equipped with handles 66. Concealed hinges may be employed so as to permit doors 64 to be opened pivotably relative to the plane defining wall 14. Shelf, not shown, may be installed within the confine of cabinet 12.

FIG. 2 illustrates floor 68 shown supported by joists in 70 and ceiling 72 shown suspended from beams 74 and having wall 50 running there behind. Molding 52 is shown. Rubber-like gasket 24 is disposed directly beneath the lowermost lateral surface 76 of ceiling 72 and in touching engagement with the top of cabinet 12. A molding portion 78 is located below cabinet 12. Tubular sleeves 40 are located at a convenient height disposed against wall 50 and intermediate post portions 32 and 46. Structural support of ceiling beams 74 prevent inadvertent damage to ceiling 72 when post portion 32 is forced upwardly in the direction of arrow 80.

FIG. 3 illustrates lowermost post portion 46 provided with annular protrusion 48 extending radially outwardly from the longitudinal axis of post portion 46 depicted by dotted line 62. Post portion 32 is shown having lowermost end 32 thereof shown partially concealed within sleeve 40. Washer-like element 82 is shown secured to the lowermost end 42 of post portion 32 and has uppermost end 84 of threaded rod 86 extending to a hole therein. Nut 88 is shown secured to threaded rod 86 by weldment 90. Washers 92 and 94 are shown secured to the uppermost end 44 of lowermost post portion 46 by utilizing the weldments 96 and 98 respectively. Washers 92 and 94 have threaded openings in which portions 100 and 102 of threaded rod 86 threadingly engage. Sleeve 40 may be positioned upwardly, in the direction of arrow 104 from protrusion 48, exposing nut 88 for turning purposes. When nut 88 is turned, threaded rod 86 will move in the direction of arrow 104, or counter thereto, dependent upon the direction of rotation. When threaded rod 86 moves in the direction of arrow 104, uppermost portion 32 will similarly move, being supported by nut 88 resting against washer 82. Conversely, when nut 88 is rotated in an opposite direction, uppermost portion 32 will be forced to move downwardly in the direction opposite the arrow 104. Thus, post portion 32 and 46 are extensible relative to one another having their extending mechanism concealed by tube 40.

One of the advantages of the present invention is to provide a portable storage apparatus conveniently and easily installed within a room utilizing the ceiling and floor therefor without requiring the need for fastening devices such as screws and bolts marring the surface of walls, floor, or ceiling.

Another advantage of the present invention is to provide a storage device wherein the area of engagement of the ceiling is substantial thereby minimizing the possibility of marring the ceiling which may be exposed to view when the storage device is moved to another location or removed from use.

Still another advantage of the present invention is to provide a portable storage device which accommodates convenient installation in a room abutting a wall thereof so as to accommodate and maximize the use of the area immediately below the cabinet for other purposes.

Yet another advantage of the present invention is to provide a storage device which may be adjusted in height so as to be conveniently installed in rooms whose height varies.

Another advantage of the present invention is to provide a storage apparatus which is adapted to accommodate a molding located adjacent the intersection of a wall and floor below the location of the cabinet.

Still another advantage of the present invention is to provide a storage device which utilizes only a pair of support poles residing adjacent to and configured to follow the contours of the wall to which the cabinet is located.

Thus, there is disclosed in the above description and in the drawings, an embodiment of the invention which fully and effectively accomplished the objects thereof. However, it will become apparent to those skilled in the art, how to make variations and modifications to the instant invention. Therefore this invention is to be limited, not by the specific disclosure herein, but only by the appending claims.

The embodiment of the invention in which an exclusive privilege or property is claimed are defined as follows:

1. A portable storage apparatus comprising a storage enclosure having walls, a base and an uppermost surface, a pair of uppermost post portions, a pair of lowermost post portions, said pair of uppermost post portions having the uppermost ends thereof fixedly secured to said enclosure, said pair of lowermost post portions extendably affixed to said pair of uppermost post portions, means to manually adjust said pair of lowermost post portions extendably and relative to said pair of uppermost post portions, said pair of lowermost post portions each having an uppermost portion thereof disposed adjacent to a lowermost portion of said uppermost pair of post portions, the longitudinal axis of said uppermost portion of said lowermost pair of post portions being displaced radially outwardly from the longitudinal axis of the lowermost portion of said pair of lowermost post portions, a pair of tubes, said pair of tubes slidably affixed over said lowermost portions and said uppermost portions of said lowermost pair of post portions, a pair of threaded rods, one end of said threaded rods threadingly engaged and co-axially aligned to said uppermost portion of said lowermost pair of post portions, a pair of nuts, said pair of nuts threadingly engaged and fixedly secured to said pair of rods, said pair of tubes being movable upwardly along said lowermost past portions exposing said pair of rods and said pair of nuts for the vertical adjustment of said pair of lowermost post portions, the other end of said pair of rods engaged within a hole located at said lowermost portion of said uppermost pair of post portions and aligned co-axially therewith, whereby rotating said pair of rods positions said threaded rods along said longitudinal axis providing vertical support for said pair of uppermost post portions having the lowermost portions thereof resting on said pair of nuts, means to support said pair of tubes covering said threaded rods and said pair of nuts in a lowermost position of said pair of tubes, a rubber-like gasket, said gasket secured to said uppermost surface, said gasket located adjacent the marginal edges of said uppermost surface, said gasket being disposed in touching engagement with a ceiling vertically supporting said enclosure.

2. The apparatus as claimed in claim 1 wherein said uppermost portion of said pair of uppermost post portions is disposed located residing extending parallel to a plane defined by one of said walls immediately adjacent thereto such that portions of the surface of said uppermost pair of post portions reside in said plane.

* * * * *